United States Patent [19]

Ueno

[11] Patent Number: 4,487,354

[45] Date of Patent: Dec. 11, 1984

[54] TAG ATTACHING DEVICE

[75] Inventor: Hideyuki Ueno, Yokohama, Japan

[73] Assignees: Toska Co., Ltd.; Bano'k Co., Ltd., both of Tokyo, Japan; Ben Clements & Sons, Inc., South Hackensack, N.J.

[21] Appl. No.: 316,713

[22] Filed: Oct. 30, 1981

[30] Foreign Application Priority Data

Nov. 11, 1980 [JP] Japan ..... 55-157663

[51] Int. Cl.[3] ..... B25C 1/00

[52] U.S. Cl. ..... 227/67; 493/375

[58] Field of Search ..... 227/67; 493/375

[56] References Cited

U.S. PATENT DOCUMENTS

| | | | |
|---|---|---|---|
| 3,089,694 | 5/1963 | Smith et al. | 493/375 X |
| 3,650,452 | 3/1972 | Finke | 227/67 |
| 3,652,004 | 3/1972 | Lozio | 227/67 |
| 3,901,428 | 8/1975 | Grass | 227/67 |
| 3,924,788 | 12/1975 | Furutu | 227/67 |
| 4,331,276 | 5/1982 | Bourque | 227/67 X |
| 4,367,834 | 1/1983 | Lozio | 227/67 |

*Primary Examiner*—James F. Coan

*Attorney, Agent, or Firm*—Blum, Kaplan, Friedman, Silberman & Beran

[57] ABSTRACT

A tag attaching device for attaching a price tag or the like to a commodity, which has the construction in which a push rod moving in the axial direction of a hollow needle equipped with a transverse groove and disposed at the front portion of the main body of the device is disposed at the back of the hollow needle and is moved by a lever mechanism so that a transverse bar of a tag pin is pushed into the hollow needle. A buffer is disposed on a grip of the device at such a position where it comes into contact with a member for driving the push rod during operation of the tag attaching device.

10 Claims, 10 Drawing Figures

DETAILED DESCRIPTION OF THE INVENTION

In the conventional tag attaching device illustrated in FIG. 1, a lever 2 is fitted to a grip 1*a* of a main body 1 and is allowed to rock and movement of this lever 2 is transmitted to an intermediate lever 3 and to a slider 4. A push rod 5 is thus moved towards a hollow needle 6 equipped with a transverse groove 6 and in turn pushes the horizontal bar of a tag pin, which is situated at the back of the hollow needle 6, into the hollow needle so that the bar is fed into the back of clothes, through which the hollow needle 6 penetrates, and the tag pin fixes the tag to the clothes. A guide groove 7 is disposed at the front of the main body 1 of the tag attaching device A, and the interconnecting rod R of the tag pin assembly T, shown in FIG. 2, is inserted into this guide groove 7. Whenever the tag pin t is punched, the interconnecting rod R is delivered downward by a gear mechanism 9 and the transverse rod of the lowermost tag pin is sequentially positioned at the inlet of the hollow needle 6. When the transverse bar B of the tag pin t is pushed into the hollow needle 6 by the push rod 5, the interconnecting portion C is cut by a cutter blade 8, thus separating a piece of tag pin t from the tag pin assembly T and punching it into the commodity.

FIG. 2 is a side view of the tag pin assembly. The tag pin t consists of the head H, the filament F and the transverse bar B and is connected to the interconnecting rod R by the interconnecting portion C. Generally, a piece of tag pin assembly T includes 20 to 30 tag pins, though the number varies depending upon the length of the filament F.

FIG. 3 is an enlarged view and shows the stretched state of the filament F. FIG. 3(A) shows the unstretched state of the filament F, FIG. 3(B) shows the state in which the necking portion N take places due to the start of stretching and FIG. 3(C) shows the state in which the stretched portion S occurs between the unstretched portions as stretching of the necking portion N further proceeds. As tension is allowed to act upon the filament in the direction of its length, necking N occurs instantaneously whereby the cross-section of the filament diminishes and stretching proceeds, forming the stretched portion.

FIG. 4 shows the principal portions of the tag attaching device in accordance with a first embodiment of the present invention. A buffer 10 is supported by a shaft 11 at a position where the intermediate lever 3 comes into pressure contact with the buffer. As the buffer 10, an air pillow-like buffer, a sponge-like buffer or a buffer using an elastomer such as rubber is employed. The buffer is fitted to the main body 1 by the shaft 11, which shaft is movably supported along the guide groove 12.

Next, the operation of the tag attaching device will be described. FIG. 4 shows the state before attaching the tag pin. The interconnecting rod R of the tag pin assembly T is inserted into the guide groove 7 and prepares for punching, and the transverse bar B of the lowermost tag pin t is situated at the inlet of the hollow needle 6 equipped with the transverse groove. Now, when the lever 2 is gripped and rotated in the direction indicated by X, the push rod 5 moves in the direction indicated by $X_1$ via the intermediate lever 3. The front edge of the intermediate lever 3 then comes into contact with the buffer 10, reaching the stage shown in FIG. 5.

FIG. 7 is a diagram showing the relation between the moving speed of the push rod 5 (the ordinate) and the moving distance of the intermediate lever 3 (the abscissa). The zone ranging from A to B represents the state from FIG. 4 to FIG. 5, and the push rod 5 moves at a high speed in the direction of $X_1$. When the push rod 5 moves as shown in FIG. 5, its tip comes into contact with the rear end of the transverse bar B of the tag pin t.

FIG. 6 shows the state in which the lever 2 is further gripped. The buffer 10 is pressed by the intermediate lever 3. Since this buffer 10 is made of a flexible material, it undergoes deformation as it is pressed between the front surface of the intermediate lever 3 and the inner wall of the main body 1. In this case, the shaft 11 moves along the guide groove 12. Under this stage, the shaft describes the curve C after passing through the point B in FIG. 7 and according to this curve C, the moving speed of the push rod 5 is shown decreasing remarkably than before. This curve C represents the state in which a piece of tag pin t is cut off from the tag pin assembly T, is pushed into the hollow needle 6 equipped with the transverse groove and is then pushed out from the tip of the hollow needle 6. As the head H of the tag pin t comes into a commodity such as clothes and the transverse bar B is compulsively pushed inside the hollow needle 6 by the push rod 5, the filament F is stretched in the interim, as shown in FIG. 3.

It is necessary that the filament F be stretched by the punching operation. Hence, the length of the filament is selected so as to be shorter than the length of the filament of the ordinary tag pin and to attain a predetermined length by stretching.

In the range of the curve C in FIG. 7, the moving speed of the push rod 5 drops, as described above. Necking N occurs on the filament F as shown in FIG. 3(B) and the reduced portion propagates in the direction of length of the filament, forming the stretched portion S as shown in FIG. 3(C).

FIG. 8 shows a second embodiment of the present invention, in which a rubber cushion or a bellows-like cushion molded from a synthetic resin is used as the buffer 10*a*.

FIG. 9 shows a third embodiment of the present invention, in which the buffer 10*b* consists of a plate 10*c* which is supported so as to be capable of rocking, and a spring 10*d* for supporting the plate 10*c*.

FIG. 10 shows still another embodiment in which a combination of a cylinder 10*f* and a piston 10*g* is used as the buffer 10*e*. A return spring for returning the piston 10*g* may be disposed inside the cylinder 10*f*, if necessary. As an example of modification of this embodiment, the intermediate lever 3 may be interconnected to the rod of the piston 10*g* so that the intermediate lever 3 has a kind of braking action.

As described in detail in the foregoing, the buffer 10 is permitted to act upon the driving member for the push rod 5, or the intermediate lever 3 in the embodiments in the present invention, to reduce the moving speed of the push rod 5 during the period in which the transverse bar B of the tag pin t moves inside the hollow needle 6 equipped with the transverse groove. According to this arrangement, necking N is allowed to slowly occur on the filament F and under such a stage, the filament can be stretched.

As the cross-section of the filament is smoothly diminished in the above-mentioned manner, breakage of the filament F during punching can be prevented.

In accordance with the present invention, the speed is reduced while the transverse bar B of the tag pin t

TAG ATTACHING DEVICE

FIELD OF THE INVENTION

This invention relates to an improvement in or relating to a tag attaching device for attaching a fastener or a tag pin (hereinafter referred to the "tag pin") for attaching tags or the like to commodities.

BACKGROUND OF THE INVENTION

As illustrated in FIG. 2, the tag pin consists of a head H, a transverse bar B and a filament F for interconnecting the head to the bar. In producing the tag pin, an interconnecting portion C is disposed in the direction of extension of the filament F and is connected to an interconnecting rod R to form a fastener or tag pin assembly T (hereinafter referred to as the "tag pin assembly") which has a comb-like shape as a whole.

The tag pin assembly T is molded from a linear high polymer such as nylon, polypropylene or the like.

In ordinary production methods of the tag pin assembly T, a mold is heated to a high temperature and a hot-melt resin is charged into the mold. The tag pin assembly T thus obtained is crystallized as a whole. When the filament F interconnecting the head H to the transverse bar B is stretched, molecular orientation takes place so that the filament becomes tough and thin and stiffness increases at the interconnecting portion between the filament F and the transverse bar B. This facilitates the punching work of the tag pin to a commodity by use of the tag attaching device in order to put the tag to the commodity. In addition, since the filament is thin, it does not damage fiber products.

However, in the tag pin produced by these methods, the filament has already been stretched so that a large number of pairs of socks or gloves, for example, can not be bundled firmly.

Another problem is that if the length of the filament is predetermined, tag pins having various lengths must be prepared to meet with intended applications. Since the mold and product management become thus complicated, the cost of production of the tag pins becomes unavoidably higher.

To eliminate the problem with the conventional tag pin having the stretched filament, the inventors of the present invention developed a tag tip whose filament could be stretched when the tag was punched by the tag attaching device. This tag pin could be obtained by rendering at least the filament portion non-crystalline. As the filament of this novel tag pin could be stretched when the tag pin was punched by the tag attaching device, the filament length could freely be adjusted. Commodities bundled by this tag pin exhibited unitary and excellent packaging form. An advantage for product management could also be obtained because tag pins suited for plural applications could be produced using one kind of mold.

When the tag pin having the stretchable filament was loaded to the ordinary tag attaching device and punched to a commodity, however, a critical problem was found out. For, since the non-crystalline filament can be stretched at room temperature, it does not need any heat-stretcher, in particular, but the stretching starting state is extremely delicate. At the start of stretching, necking (contracted portion) occurs at a part of the filament to rapidly reduce its cross-section and then this contracted portion propagates in the direction of length of filament. In conjunction with the stretching behaviour, filament is cut if tension is quickly applied until necking occurs but once necking does occur, the filament does not break up to a considerably high stretching speed.

Meanwhile, punching of the tag pin by use of the conventional tag attaching device is carried out in the same routine as that of the tag pin having the stretched filament. As shown in FIG. 1, the tag attaching device has a pistol-like shape and as its grip 2 is gripped, the transverse bar of the tag pin is pushed into a needle equipped with a groove. However, since the lever gripping speed is considerably high, the transverse bar of the tag pin is pushed into the needle equipped with a groove at a speed which is by far higher than the stretching speed that is optimal for the occurrence of necking. Hence, the filament is likely to break.

To eliminate this problem, the inventors of the present invention have examined the stretching speed and have found that breakage of the filament can be prevented almost perfectly if the lever of the tag attaching device is gently pulled at the initial stage so as to push the transverse bar of the tag pin at a slow speed and thereafter the lever is pulled at an ordinary speed.

SUMMARY OF THE INVENTION

The present invention is perfected on the basis of the finding described above, and is directed to provide a device which reduces the punching speed of the tag pin at the stretching step of the filament, without the necessity of markedly changing the construction of the convention tag attaching device.

In the tag attaching device, the construction of the present invention to accomplish this object is characterized in that a buffer is disposed on the grip of the device and a member for driving the push rod comes into contact with the buffer during operation of the device and reduces the speed of the push rod during the period in which the transverse bar of the tag pin moves inside the hollow needle.

This and other objects of the invention will become more apparent from the following description.

Figure 1:
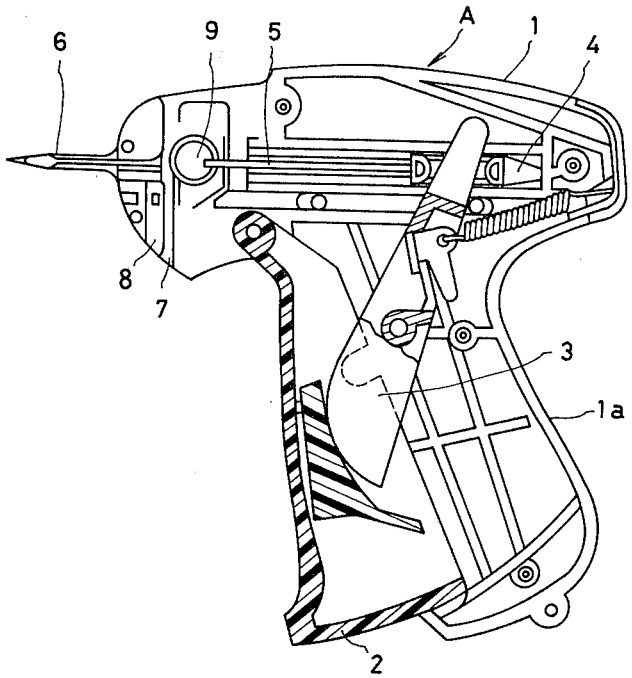
FIG.1 PRIOR ART
FIG. 1 is a sectional view useful for explaining the internal construction of the conventional tag attaching device.
Figure 2:
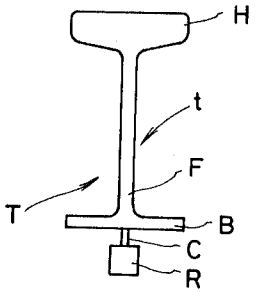
FIG. 2 is a side view of the tag pin assembly having the unstretched filament.
Figure 3:
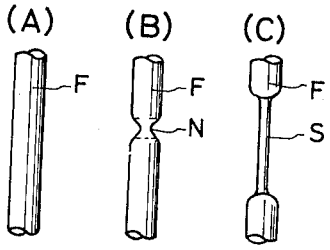
FIGS. 3(A), (B) and (C) are schematic views useful for explaining the stretched state of the filament shown in FIG. 2.
Figure 4:
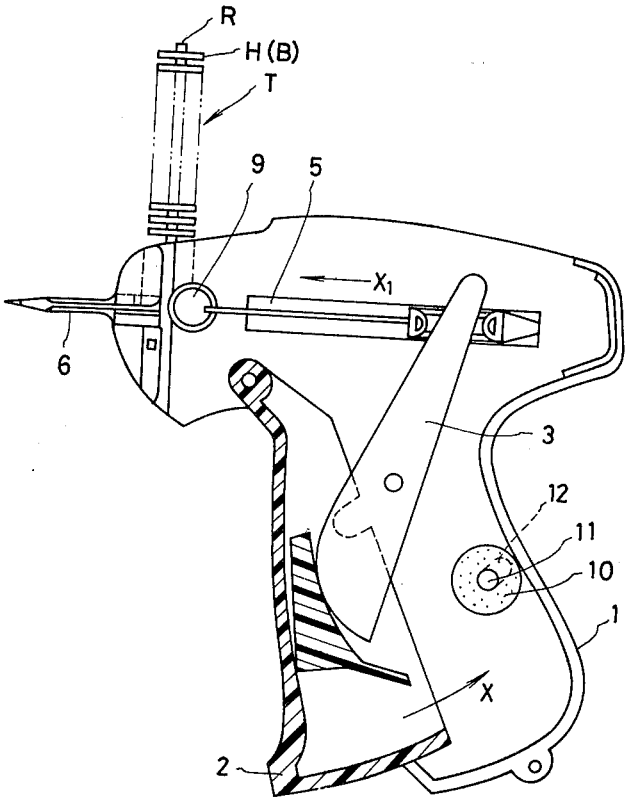
FIG. 4 is a sectional view useful for explaining the tag attaching device in accordance with an embodiment of the present invention.
Figure 5:
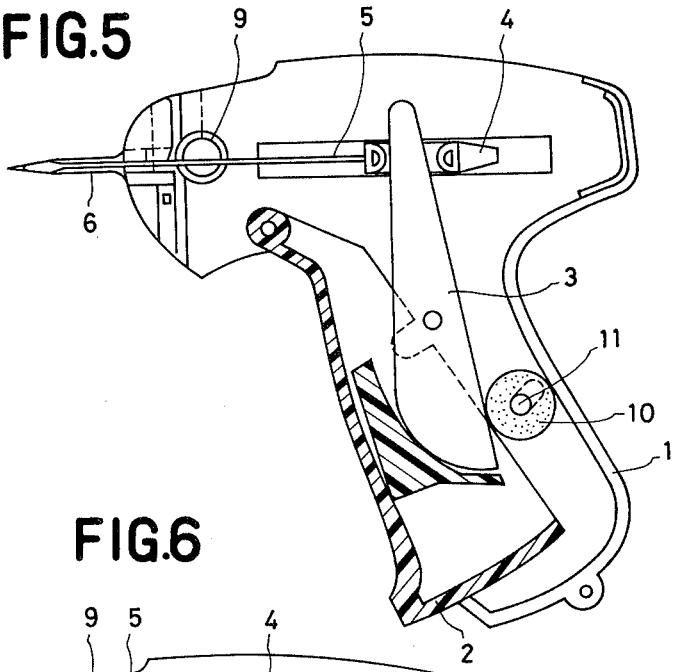
FIGS. 5 and 6 are schematic sectional views useful for explaining the tag attaching device shown in FIG. 4.
Figure 6:
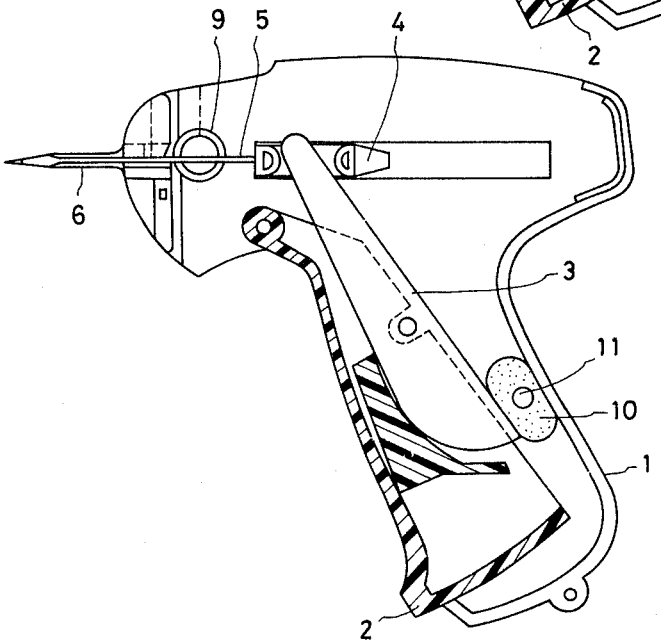
Figure 7:
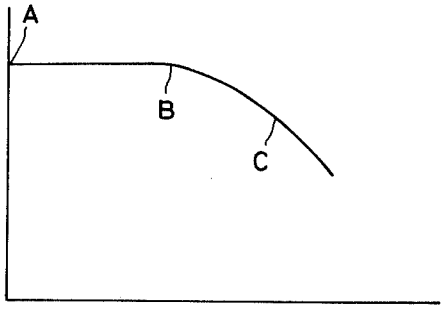
FIG. 7 is a diagram showing the relation between the moving speed of the push rod and the moving distance of the intermediate lever in the tag attaching device shown in FIGS. 4 through 6.
Figure 8:
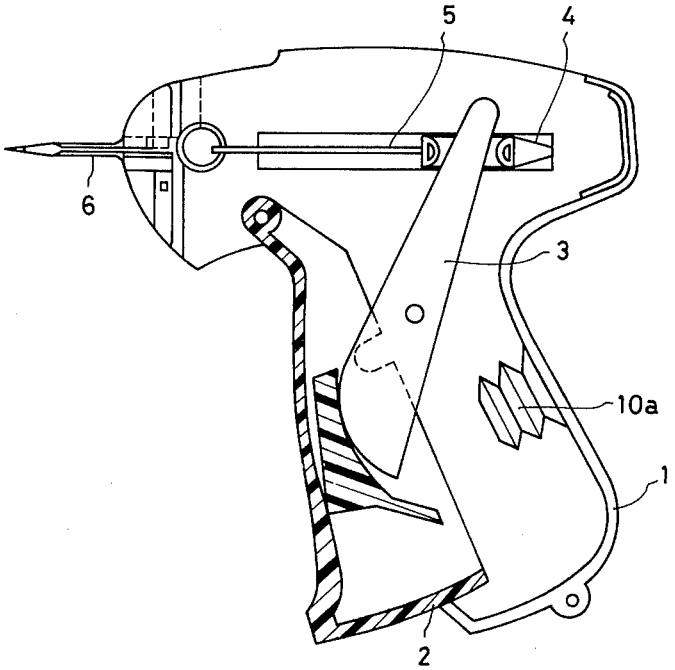
FIGS. 8, 9 and 10 are schematic sectional views useful for explaining the principal portions of the tag attaching device in other embodiments of the present invention.
Figure 9:
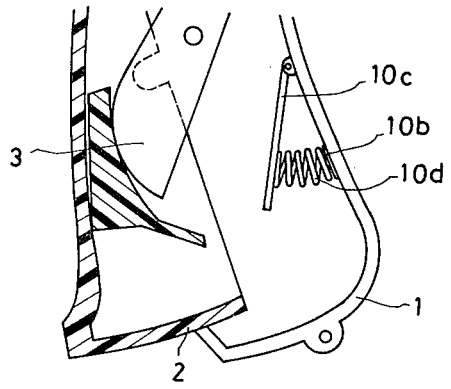
Figure 10:
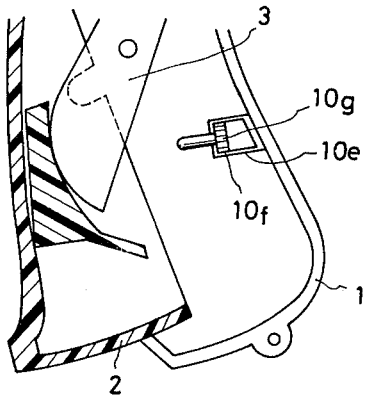

moves inside the hollow needle 6 equipped with the transverse groove so that start of stretching of the stretchable film F can be facilitated without causing its breakage. Hence, the filament can be punched efficiently into the commodity while it is being stretched.

As the filament stretching speed is significantly affected by the buffer action, it is possible to reduce variance in the punching speeds resulting from different operators of the tag attaching device.

The present invention can effectively be utilized for the tag pin having the filament under the non-crystalline state in punching the tag pin with stretching of the filament. The present invention can also be used not only for tag pins using a flexible material such as polyurethane but also for tag pins having a filament that has already been stretched.

What is claimed is:

1. In a tag attaching device of the type in which a push rod moving in the axial direction of a hollow needle equipped with a transverse groove is disposed at the back of said hollow needle disposed at the front portion of a main body and is moved by a lever mechanism so as to push a transverse bar of a tag pin into said hollow needle, the improvement comprising a buffer means, a member which drives said push rod comes into contact with said buffer means during the operation of said tag attaching device and reduces the moving speed of said push rod during the period in which said transverse bar moves inside said hollow needle.

2. The tag attaching device as defined in claim 1, wherein said buffer means is disposed at a position where said buffer comes into contact with the lower portion of said member for driving said push rod.

3. The tag attaching device as defined in claim 1, wherein said buffer means is supported by a shaft projecting from the inner side surface of a grip.

4. The tag attaching device as defined in claim 3, wherein said shaft is movably supported along a guide groove formed on the inner side surface of said grip.

5. The tag attaching device as defined in claim 1, wherein said buffer means is made of an elastic material.

6. The tag attaching device as defined in claim 5, wherein said elastic material is air pillow-like, sponge-like or rubber-like.

7. The tag attaching device as defined in claim 1, wherein said buffer means is a bellows-like cushion made of rubber or molded from a synthetic resin.

8. The tag attaching device as defined in claim 1, wherein said buffer means consists of a plate supported so as to be capable of rocking and a spring for supporting said plate.

9. The tag attaching device as defined in claim 1, wherein said buffer means consists of a combination of a cylinder and a piston.

10. The tag attaching device as defined in claim 9, wherein a spring for returning said piston is disposed inside said cylinder.

* * * * *